US011655671B2

(12) United States Patent
He et al.

(10) Patent No.: US 11,655,671 B2
(45) Date of Patent: May 23, 2023

(54) CONNECTING ASSEMBLY, DOOR GUARDRAIL AND FENCE

(71) Applicant: Zhongshan Ekar Uping Houseware Co., Ltd., Zhongshan (CN)

(72) Inventors: Jianghua He, Zhongshan (CN); Guozhu Feng, Zhongshan (CN); Xinliang Ouyang, Zhongshan (CN)

(73) Assignee: ZHONGSHAN EKAR UPING HOUSEWARE CO., LTD., Zhongshan (CN)

( * ) Notice: Subject to any disclaimer, the term of this patent is extended or adjusted under 35 U.S.C. 154(b) by 72 days.

(21) Appl. No.: 17/392,547

(22) Filed: Aug. 3, 2021

(65) Prior Publication Data

US 2022/0396995 A1 Dec. 15, 2022

(30) Foreign Application Priority Data

Jun. 15, 2021 (CN) ..... 202121327526.2

(51) Int. Cl.
*E06B 9/04* (2006.01)
*E05B 65/00* (2006.01)
*E06B 9/00* (2006.01)

(52) U.S. Cl.
CPC ..... *E06B 9/04* (2013.01); *E05B 65/0007* (2013.01); *E06B 2009/002* (2013.01)

(58) Field of Classification Search
CPC ..... E06B 9/04; E06B 9/02; E06B 2009/002; E06B 11/02; E06B 7/32; E05B 65/0007; E05B 65/0014
See application file for complete search history.

(56) References Cited

U.S. PATENT DOCUMENTS 6,536,502 B2 * 3/2003 Britto ..... E06B 9/08 160/293.1
7,318,298 B2 * 1/2008 Marsden ..... E06B 9/04 49/463
7,373,755 B2 * 5/2008 Jefferys ..... E06B 9/04 49/55
7,540,046 B1 * 6/2009 Lai ..... A47D 13/065 5/100
7,627,985 B2 * 12/2009 Marsden ..... E05B 65/0014 49/394
7,963,575 B2 * 6/2011 Mayo ..... E06B 9/04 49/57
8,713,851 B2 * 5/2014 Flannery ..... E06B 9/04 49/55
9,279,284 B1 * 3/2016 Axelrod ..... E06B 7/32
9,382,750 B1 * 7/2016 Flannery ..... E05C 3/16
9,388,603 B2 * 7/2016 Flannery ..... E05C 1/10
9,464,467 B1 * 10/2016 Flannery ..... E05B 65/0007
9,587,426 B1 * 3/2017 Flannery ..... E05C 1/12
9,637,959 B2 * 5/2017 Marsden ..... E05C 19/003
(Continued)

*Primary Examiner* — Justin B Rephann
(74) *Attorney, Agent, or Firm* — Leason Ellis LLP

(57) ABSTRACT

Disclosed are a connecting assembly, a door guardrail and a fence using the connecting assembly. The connecting assembly includes a first connector and a second connector, a transverse locking device and a longitudinal locking device are arranged between the first connector and the second connector, and the longitudinal locking device is capable of limiting relative movement of the first connector and the second connector in a transverse direction.

8 Claims, 4 Drawing Sheets

(56) References Cited

U.S. PATENT DOCUMENTS

| | | | | |
|---|---|---|---|---|
| 10,907,382 | B2 * | 2/2021 | Raffi | E05B 59/00 |
| 11,041,340 | B1 * | 6/2021 | Flannery | E05C 1/16 |
| 11,149,488 | B2 * | 10/2021 | Wang | E06B 9/04 |
| 11,371,264 | B2 * | 6/2022 | Zhang | E05B 65/0007 |
| 2002/0179257 | A1 * | 12/2002 | Britto | E06B 9/08 160/294 |
| 2006/0055182 | A1 * | 3/2006 | Jefferys | E05F 1/066 292/251.5 |
| 2006/0175028 | A1 * | 8/2006 | Askinasi | E06B 9/02 160/225 |
| 2006/0185253 | A1 * | 8/2006 | Marsden | E05B 65/0014 49/465 |
| 2006/0207180 | A1 * | 9/2006 | Cheng | E05B 65/0014 49/57 |
| 2008/0284180 | A1 * | 11/2008 | Newcombe | E06B 9/04 292/198 |
| 2009/0013604 | A1 * | 1/2009 | Yates | E05B 65/0014 49/506 |
| 2012/0011775 | A1 * | 1/2012 | Chen | E05B 47/004 49/358 |
| 2012/0255234 | A1 * | 10/2012 | Wang | E06B 9/04 49/394 |
| 2012/0324792 | A1 * | 12/2012 | Bertsch | E06B 9/04 49/37 |
| 2013/0160365 | A1 * | 6/2013 | Flannery | E05C 1/10 49/50 |
| 2017/0350165 | A1 * | 12/2017 | Schort | E05B 65/0007 |
| 2018/0148954 | A1 * | 5/2018 | Raffi | E05B 59/00 |

* cited by examiner

CONNECTING ASSEMBLY, DOOR GUARDRAIL AND FENCE

CROSS-REFERENCE TO RELATED APPLICATIONS

This application is based on and claims the benefit of priority from Chinese Patent Application No. 202121327526.2, filed on 15 Jun. 2021, the entirety of which is incorporated by reference herein.

TECHNICAL FIELD

The disclosure relates to the field of barriers, and more particularly, to a connecting assembly, a door guardrail and a fence.

BACKGROUND

As everyone knows, people arrange door guardrails at certain entrances and exits to restrict animals or children from entering and leaving certain areas.

Existing door guardrail is generally provided with one set of transverse locking device between a door frame and a guardrail door body, the transverse locking device includes a transverse slot arranged on one side wall of the door frame and a transverse pin arranged on a free side wall of the guardrail door body, the transverse pin is correspondingly inserted into the transverse slot, so that a relative position between the door frame and the guardrail door body is locked. When the transverse pin is withdrawn from the transverse slot, the door guardrail can be opened. Although the above door guardrail is capable of restricting children or animals from entering certain areas, it is easy for children to push the transverse pin out of the transverse slot to unlock the door guardrail, so that the door guardrail is not safe enough.

SUMMARY

The disclosure aims to solve at least one of the technical problems in the existing technology. For this purpose, a first aspect of the disclosure provides a connecting assembly, which enables connection between a first connector and a second connector firmer.

A second aspect of the disclosure provides a door guardrail, which uses the above connecting assembly, so that the door guardrail is not easy for children to open, thus improving a safety performance of the door guardrail.

A third aspect of the disclosure provides a fence, which uses the above connecting assembly, so that connection between two adjacent fence plates is firmer.

The following technical solutions are used in the disclosure to solve the above technical problems.

The connecting assembly according to some embodiments of the first aspect of the disclosure includes a first connector; a second connector; a transverse locking device, the transverse locking device includes a transverse slot and a transverse pin which are capable of being matched and clamped with each other, the transverse pin is movably arranged on the second connector or the first connector, the transverse slot is correspondingly arranged on the first connector or the second connector, and the transverse pin is movable along a transverse direction to insert into or withdraw from the transverse slot; and a longitudinal locking device arranged between the first connector and the second connector, wherein the longitudinal locking device is capable of limiting relative movement of the first connector and the second connector in a transverse direction.

The connecting assembly according to some embodiments of the first aspect of the disclosure has the advantages as follows. By arranging the transverse locking device and the longitudinal locking device between the first connector and the second connector, the first connector and the second connector can be doubly locked by the transverse locking device and the longitudinal locking device, so that connection between the first connector and the second connector is firmer. Moreover, locking between the first connector and the second connector is not easy for children to release, so that connection between the first connector and the second connector is effective and reliable, and safety is ensured. In addition, the first connector and the second connector are locked by the transverse locking device and the longitudinal locking device in a transverse direction and a longitudinal direction respectively, so that the first connector and the second connector are locked in a stereoscopic manner, thus having a better locking effect.

In some embodiments of the first aspect of the disclosure, the longitudinal locking device includes a longitudinal slot and a longitudinal pin which are capable of being matched and clamped with each other. The longitudinal pin is movably mounted on the first connector or the second connector, the longitudinal slot is correspondingly arranged on the second connector or the first connector. The longitudinal pin is movable along a longitudinal direction to insert into or withdraw from the longitudinal slot.

In some embodiments of the first aspect of the disclosure, a lower portion of one end of the first connector close to the second connector is provided with a connecting portion extending and protruding outwardly. The longitudinal slot is formed on an upper surface of the connecting portion and an opening of the longitudinal slot faces upwardly, the longitudinal pin is movably mounted at one end of the second connector close to the first connector. The longitudinal pin is movable from top to bottom along a longitudinal direction to insert into the longitudinal slot, or the longitudinal pin is movable from bottom to top along a longitudinal direction to withdraw from the longitudinal slot.

In some embodiments of the first aspect of the disclosure, a lower portion of one end of the first connector close to the second connector is provided with a connecting portion extending and protruding outwardly. The longitudinal slot is formed on a lower surface of the connecting portion and an opening of the longitudinal slot faces downwardly, the longitudinal pin is movably mounted at one end of the second connector close to the first connector. The longitudinal pin is movable from bottom to top along a longitudinal direction to insert into the longitudinal slot, or the longitudinal pin is movable from top to bottom along a longitudinal direction to withdraw from the longitudinal slot.

In some embodiments of the first aspect of the disclosure, one end of the second connector close to the first connector is internally provided with an accommodating cavity, an opening communicated with the accommodating cavity is provided on an upper surface or a lower surface of the second connector, and the longitudinal pin is movably mounted inside the accommodating cavity. The accommodating cavity is internally provided with an elastic member for driving one end of the longitudinal pin to pass through the opening and extend out of the accommodating cavity. A guiding inclined plane is arranged between the connecting portion and the longitudinal pin for guiding the longitudinal pin to move towards inside of the accommodating cavity, the guiding inclined plane is formed on the connecting portion or formed on the longitudinal pin.

In some embodiments of the first aspect of the disclosure, a clamping block is arranged on an outside wall of the longitudinal pin within the accommodating cavity. The elastic member is a compression spring sleeved around a peripheral wall of the longitudinal pin. One end of the compression spring is configured to abut against the clamping block, and the other end of the compression spring is configured to abut against an inner wall of the accommodating cavity.

In some embodiments of the first aspect of the disclosure, the transverse slot is formed at one end of the first connector close to the second connector. One end of the second connector close to the first connector is provided with a cavity, and a side wall of the cavity is provided with a notch facing the transverse slot. The transverse pin is movably mounted in the cavity, and the transverse pin is insertable into the transverse slot by passing through the notch.

In some embodiments of the first aspect of the disclosure, a side wall of the second connector is provided with a strip-shaped slot communicated with the cavity.

In some embodiments of the first aspect of the disclosure, the transverse pin is connected with a connecting rod, and one end of the connecting rod is arranged to pass through the strip-shaped slot and be connected with a driving sheet located outside the cavity.

The door guardrail according to some embodiments of the second aspect of the disclosure includes a door frame and a guardrail door body hinged on one side wall of the door frame, the above connecting assembly is arranged between the guardrail door body and the door frame.

The door guardrail according to some embodiments of the second aspect of the disclosure has the beneficial effects as follows. By using the above connecting assembly between the guardrail door body and the door frame, the guardrail door body and the door frame can be doubly locked, and it is difficult for children to unlock, thus being safe and reliable. Moreover, the guardrail door body and the door frame can be locked in a stereoscopic manner by the connecting assembly, so that connection between the guardrail door body and the door frame is firmer and more reliable.

The fence according to some embodiments of the third aspect of the disclosure includes at least two fence plates, the above connecting assembly is arranged between two adjacent fence plates.

The connecting assembly according to some embodiments of the third aspect of the disclosure has the beneficial effects as follows. By connecting two adjacent fence plates with the above connecting assembly, two adjacent fence plates can be doubly locked, and it is difficult for children to unlock, thus being safe and reliable. Moreover, two adjacent fence plates can be locked in a stereoscopic manner by the above connecting assembly, so that connection between two adjacent fence plates is firmer and more reliable.

BRIEF DESCRIPTION OF THE DRAWINGS

The disclosure is further described in detail hereinafter with reference to the accompanying drawings and the specific embodiments.

DETAILED DESCRIPTION

Figure 1:
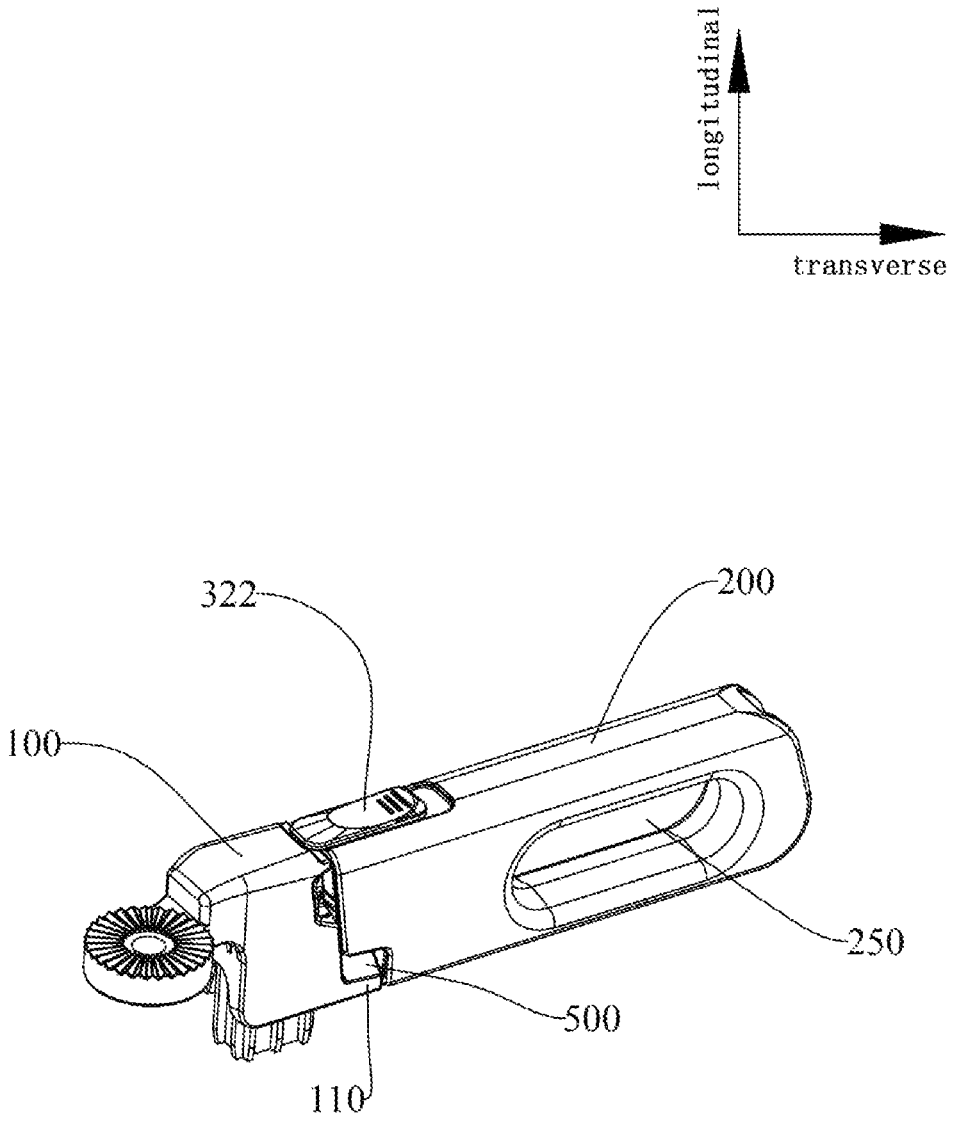
FIG. 1 is a schematic diagram of an appearance of a connecting assembly according to some embodiments of a first aspect of the disclosure.

This part will describe the specific embodiments of the disclosure in detail, and the preferred embodiments of the disclosure are shown in the accompanying drawings. The accompanying drawings are used to supplement the description of the text in the specification with the graphs, so that people can intuitively and vividly understand each technical feature and the overall technical solution of the disclosure, but the accompanying drawings cannot be understood as limiting the scope of protection of the disclosure.

In the description of the disclosure, it should be understood that the orientation or position relationship indicated by the terms up, down, front, rear, left, right, and the like is based on the orientation or position relationship shown in the accompanying drawings, it is only for the convenience of description of the disclosure and simplification of the description, and it is not to indicate or imply that the indicated device or element must have a specific orientation, and be constructed and operated in a specific orientation. Therefore, the terms shall not be understood as limiting the disclosure.

In the description of the present disclosure, the meaning of "several" is one or more, the meaning of "a plurality of" is two or more, "greater than", "less than", "more than", etc. are to be understood to exclude the given figure, and "above", "below", "within", etc. are understood to include the given figure. If "first" and "second", etc. are referred to, it is only for the purpose of distinguishing technical features, and shall not be understood as indicating or implying relative importance or implying the number of the indicated technical features or implying the sequence of the indicated technical features.

In the description of the present disclosure, unless otherwise explicitly defined, the words such as "set", "install", and "connect" should be understood in a broad sense, and those skilled in the art can determine the specific meanings of the above words in the present disclosure in a rational way in combination with the specific contents of the technical solutions.

With reference to FIG. 1 to FIG. 4, a connecting assembly according to some embodiments of a first aspect of the disclosure includes a first connector 100 and a second connector 200 which are independent of each other, which means that the first connector 100 and the second connector 200 may be separated from each other. At least one transverse locking device is arranged between the first connector 100 and the second connector 200, and it can be understood that two, three or more transverse locking devices may also be provided, which may be determined according to actual needs. The transverse locking device is configured for limiting relative movement of the first connector 100 and the second connector 200 along a longitudinal direction.

The transverse locking device mainly includes a transverse slot 310 and a transverse pin 320 which are capable of being matched and clamped with each other. The transverse pin 320 is movably mounted on the second connector 200 or the first connector 100, and the transverse slot 310 is correspondingly arranged on the first connector 100 or the second connector 200. In some embodiments of the first aspect of the disclosure, the transverse slot 310 is formed at one end of the first connector 100 close to the second connector 200, an opening of the transverse slot 310 faces the second connector 200, and one end of the second connector 200 close to the first connector 100 is provided with a cavity 230. A side wall of the cavity 230 is provided with a notch 231 facing the transverse slot 310, and the transverse pin 320 is movably mounted in the cavity 230. In a process that the transverse pin 320 moves towards to the first connector 100 along a transverse direction, the transverse pin 320 is capable of passing through the notch 231 and being correspondingly inserted into the transverse slot 310. In a process that the transverse pin 320 moves away from the first connector 100 in a transverse direction, the transverse pin 320 is capable of being withdrawn from the transverse slot 310.

In order to facilitate a user to push the transverse pin 320 to move, a side wall of the second connector 200 is provided with a strip-shaped groove 240 communicated with the cavity 230. In some embodiments of the first aspect of the disclosure, the transverse pin 320 is connected with a connecting rod 321, and one end of the connecting rod 321 passes through the strip-shaped slot 240 and is connected with a driving sheet 322 located outside the cavity 230. When the user drives the driving sheet 322 to move, the transverse pin 320 may be driven to reciprocate along a transverse direction.

At least one longitudinal locking device is arranged between the first connector 100 and the second connector 200, and it is conceivable that, according to actual needs, two, three or more longitudinal locking devices may also be arranged between the first connector 100 and the second connector 200. In some embodiments of the first aspect of the disclosure, a locking direction of the longitudinal locking device is perpendicular to a locking direction of the transverse locking device. The longitudinal locking device is capable of limiting relative movement of the first connector 100 and the second connector 200 in a transverse direction.

Figure 2:
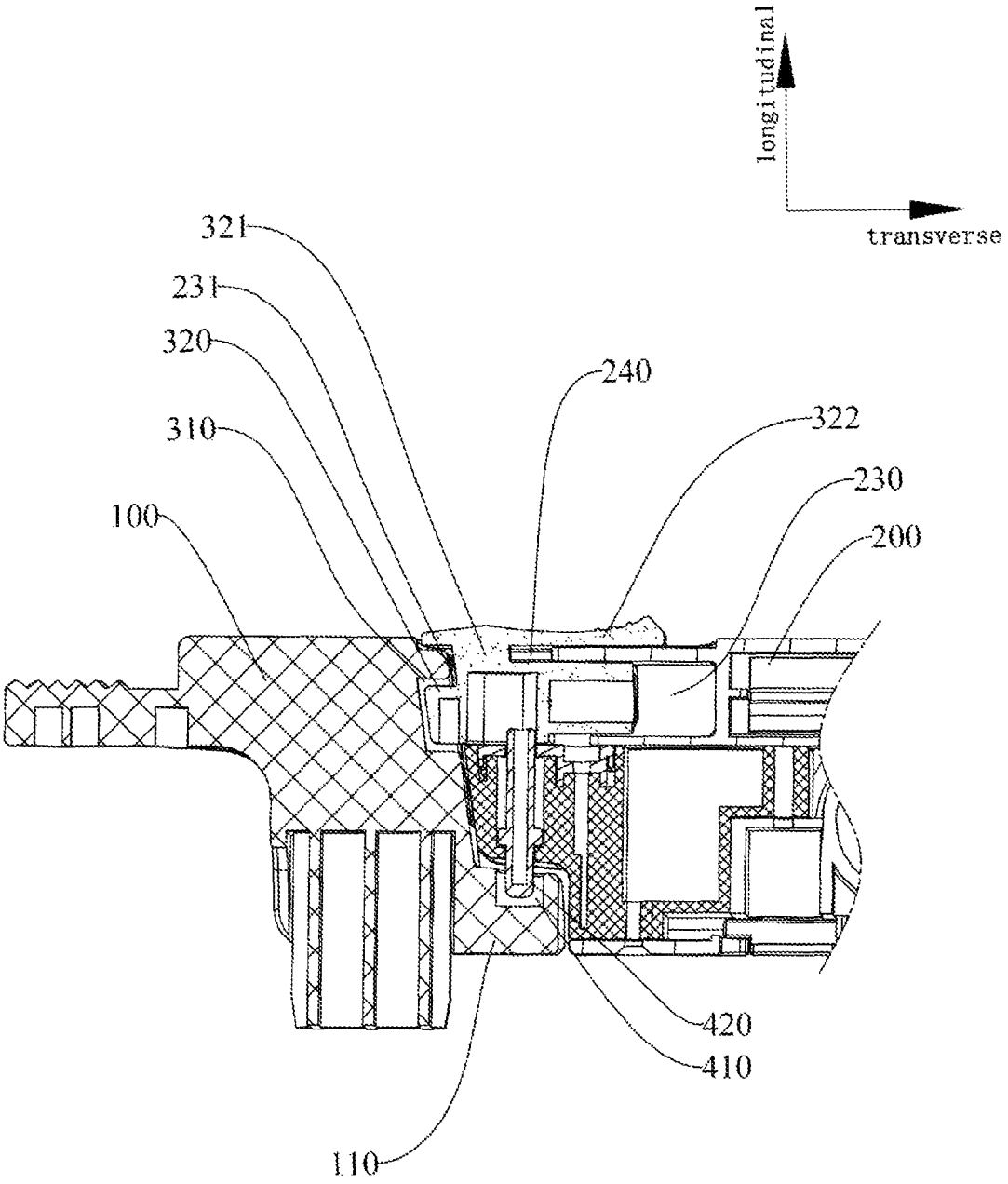
FIG. 2 is a schematic diagram of an internal structure when a transverse locking device and a longitudinal locking device are both in a locked state in the connecting assembly shown in FIG. 1.
Figure 3:
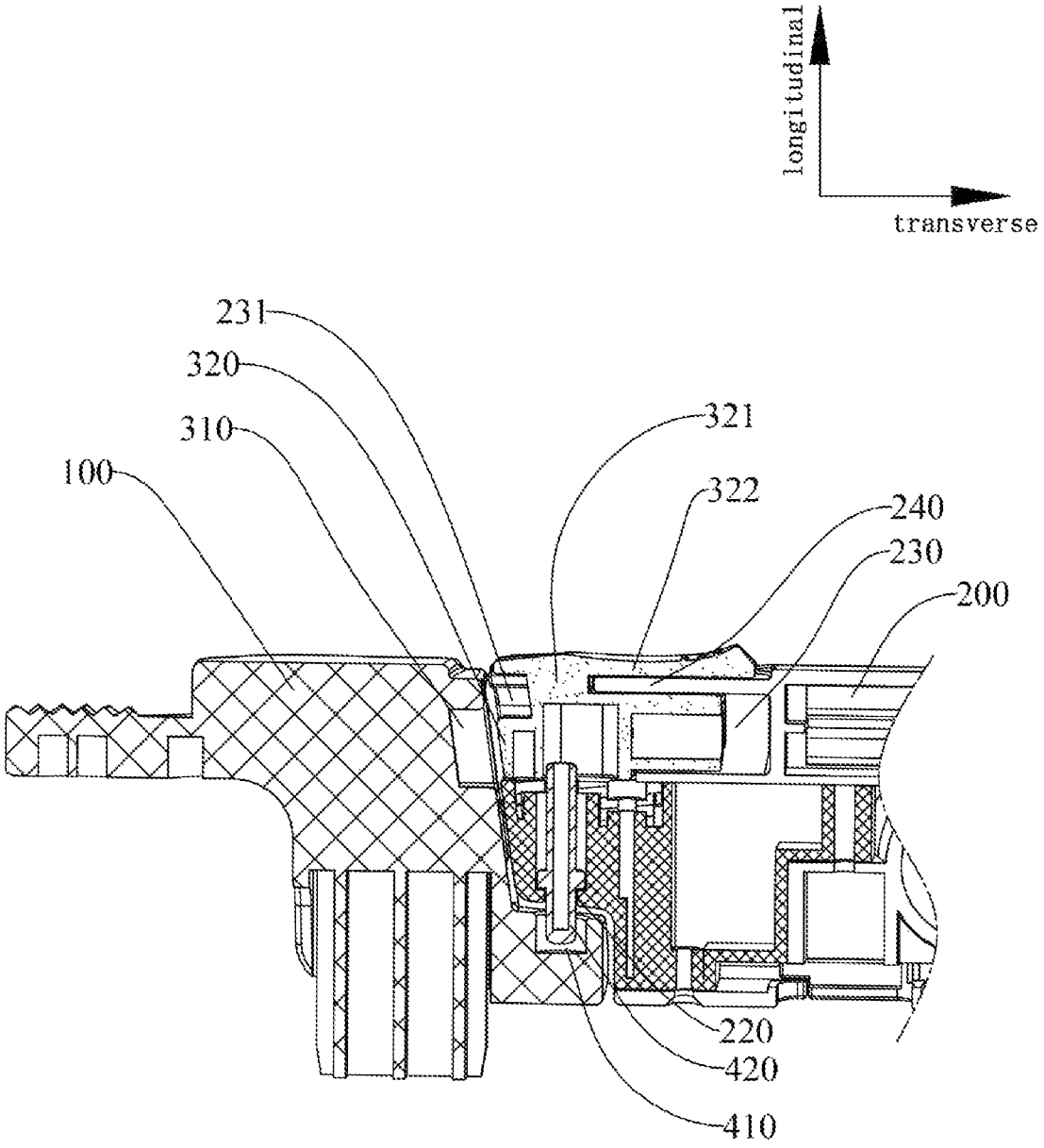
FIG. 3 is a schematic diagram of an internal structure when the transverse locking device is in an unlocked state and the longitudinal locking device is in a locked state in the connecting assembly shown in FIG. 1.
Figure 4:
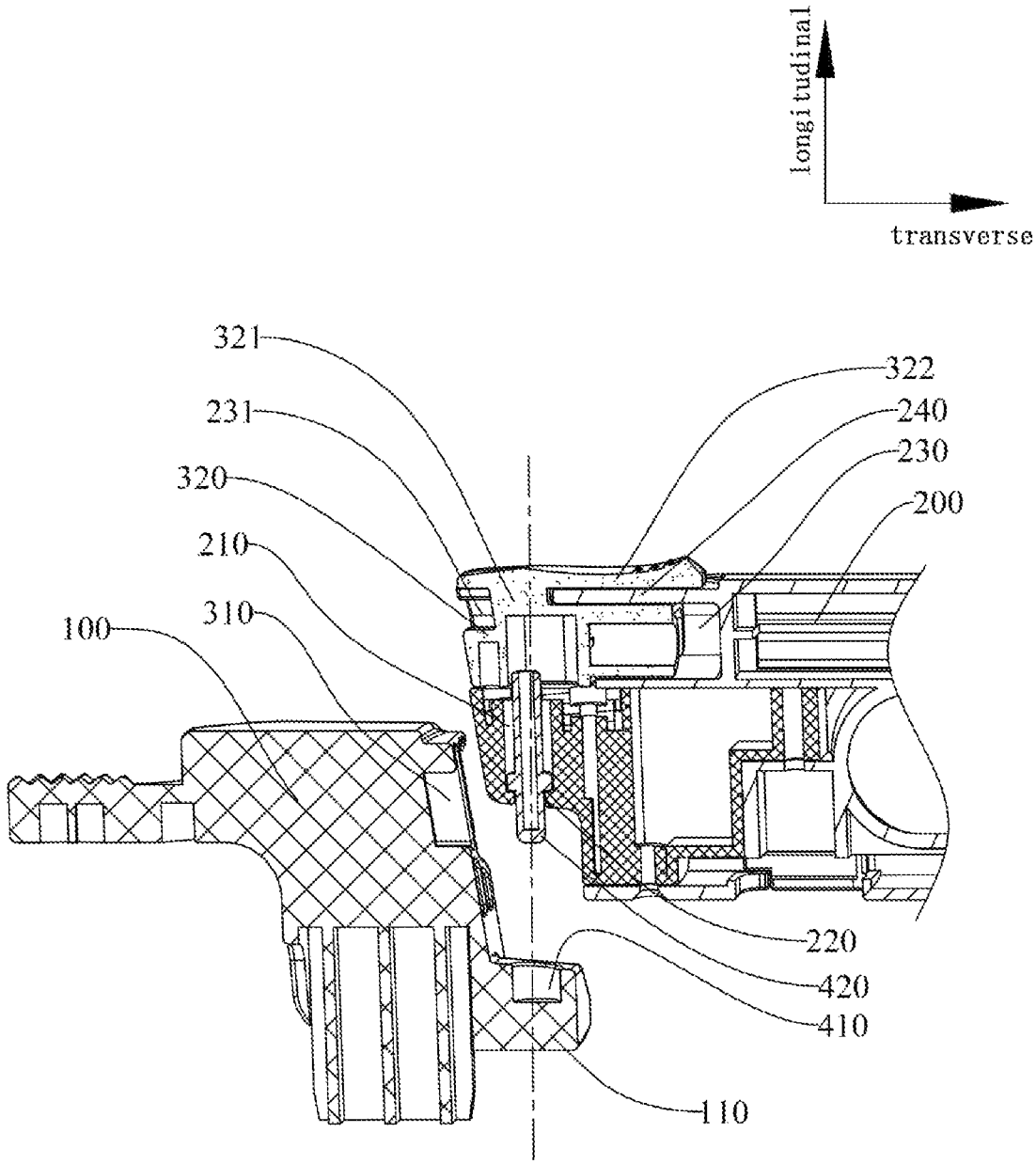
FIG. 4 is an exploded view of an internal structure when the transverse locking device and the longitudinal locking device are both in an unlocked state in the connecting assembly shown in FIG. 1.

As shown in FIG. 2 to FIG. 4, in order to make a structure of the connecting assembly simpler, in some embodiments of the first aspect of the disclosure, the longitudinal locking device mainly includes a longitudinal slot 410 and a longitudinal pin 420 which are capable of being matched and clamped with each other, the longitudinal pin 420 is movably mounted on the first connector 100 or the second connector 200, the longitudinal slot 410 is correspondingly arranged on the second connector 200 or the first connector 100, and the longitudinal pin 420 is movable along a longitudinal direction to insert into or withdraw from the longitudinal slot 410.

In order to simplify a structure of the longitudinal locking device, in some embodiments of the first aspect of the disclosure, a lower portion of one end of the first connector 100 close to the second connector 200 is provided with a connecting portion 110 extending and protruding outwardly, the longitudinal slot 410 is formed on an upper surface of the connecting portion 110 and an opening of the longitudinal slot 410 faces upwardly, the longitudinal pin 420 is movably mounted at one end of the second connector 200 close to the first connector 100, the longitudinal pin 420 is movable from top to bottom along a longitudinal direction to insert into the longitudinal slot 410, or the longitudinal pin 420 is movable from bottom to top along a longitudinal direction to withdraw from the longitudinal slot 410.

Certainly, it is conceivable that the longitudinal slot 410 may also be formed on a lower surface of the connecting portion 110 and an opening of the longitudinal slot 410 faces downwardly, the longitudinal pin 420 is movably mounted at one end of the second connector 200 close to the first connector 100. In this case, the longitudinal pin 420 is movable from bottom to top along a longitudinal direction to insert into the longitudinal slot 410, or the longitudinal pin 420 is movable from top to bottom along a longitudinal direction to withdraw from the longitudinal slot 410. The details may be determined according to actual needs.

It can be understood that the longitudinal locking device may also use other structures besides the above structure. For example, the longitudinal locking device may include two clamping hooks (not shown in the drawings) which may be matched and clamped with each other, the two clamping hooks are correspondingly arranged on outside walls of the first connector 100 and the second connector 200. When the two clamping hooks are hooked with each other, the longitudinal locking device locks the first connector 100 and the second connector 200, and at the moment, the first connector 100 and the second connector 200 cannot move relatively in a transverse direction.

With reference to FIG. 1, in order to facilitate driving the first connector 100 and the second connector 200 to move relatively in a longitudinal direction, the second connector 200 is provided with a handle hole 250 which is convenient for holding. The user can easily apply a force to the second connector 200 by holding the handle hole 250, and drive the second connector 200 to move relative to the first connector 100 along a longitudinal direction.

By arranging the transverse locking device and the longitudinal locking device between the first connector 100 and the second connector 200, when the transverse locking device and the longitudinal locking device are both locked, the first connector 100 and the second connector 200 cannot move relatively in both longitudinal direction and transverse direction, so that connection between the first connector 100 and the second connector 200 is more effective and reliable.

If the first connector 100 and the second connector 200 need to be separated, the user may push the transverse pin 320 to move away from the first connector 100 in a transverse direction first, and the transverse pin 320 is withdrawn from the transverse slot 310 to release a locking effect of the transverse locking device. At the moment, the first connector 100 and the second connector 200 are movable to separate relatively in a longitudinal direction, and then the user pushes the first connector 100 or the second connector 200 to move along a longitudinal direction, so that the longitudinal pin 420 may move along a longitudinal direction and be withdrawn from the longitudinal slot 410, thus unlocking the longitudinal locking device. At the moment, the first connector 100 and the second connector 200 are movable to separate relatively along a transverse direction.

Further, in order to better mount the longitudinal pin 420 on the second connector 200, specifically, one end of the second connector 200 close to the first connector 100 is internally provided with an accommodating cavity 210, the upper surface or the lower surface of the second connector 200 is provided with an opening 220 communicated with the accommodating cavity 210, and the longitudinal pin 420 is movably mounted inside the accommodating cavity. The accommodating cavity 210 is internally provided with an elastic member (not shown in the drawings) for driving one end of the longitudinal pin 420 to pass through the opening 220 and extend out of the accommodating cavity 210. A guiding inclined plane 500 is arranged between the connecting portion 110 and the longitudinal pin 420 for guiding the longitudinal pin 420 to move towards inside of the accommodating cavity 210, and the guiding inclined plane 500 is formed on the connecting portion 110 or formed on the longitudinal pin 420. By using the above structure, in a process that the longitudinal pin 420 is contacted with the guiding inclined plane 500, the guiding inclined plane 500 may apply a force to the longitudinal pin 420 and make the longitudinal pin move towards inside of the accommodating cavity 210, so that the longitudinal pin 420 may not interfere with relative movement and overlapping of the first connector 100 and the second connector 200. When the first connector 100 and the second connector 200 are moved to align the longitudinal pin 420 with the longitudinal slot 410, the longitudinal pin 420 is automatically inserted into the longitudinal slot 410 under driving of the elastic member, so that automatic locking of the longitudinal locking device is completed, thus being simple and convenient.

In order to further simplify the structure of the longitudinal locking device, in some embodiments of the first aspect of the disclosure, a clamping block 421 located inside the accommodating cavity 210 is arranged on an outside wall of the longitudinal pin 420. The elastic member is a compression spring (not shown in the drawings) sleeved around a peripheral wall of the longitudinal pin 420, and one end of the compression spring abuts against the clamping block 421, and the other end of the compression spring abuts against an inner wall of the accommodating cavity 210. By using the above structure, the compression spring can automatically drive the longitudinal pin 420 to pass through the opening 220 and extend out of the accommodating cavity 210.

It can be understood that the above elastic member may also be set to be a rubber pad (not shown in the drawings), one end of the rubber pad abuts against an inner wall of the accommodating cavity 210, and the other end of the rubber pad abuts against an end portion of the longitudinal pin 420 facing the inner wall of the accommodating cavity 210. By using the above structure, the rubber pad can drive the longitudinal pin 420 to automatically pass through the opening 220 and extend out of the accommodating cavity 210.

With reference to FIG. 1 to FIG. 4, a door guardrail according to some embodiments of a second aspect of the disclosure includes a door frame (not shown in the drawings) and a guardrail door body (not shown in the drawings) hinged on one side wall of the door frame, wherein the above connecting assembly is arranged between the guardrail door body and the door frame. Specifically, one of the first connector 100 and the second connector 200 is arranged on the door frame, and the other is arranged on the guardrail door body. By using the above connecting assembly between the guardrail door body and the door frame, the guardrail door body and the door frame can be doubly locked, and it is difficult for children to unlock, thus being safe and reliable. Moreover, the guardrail door body and the door frame can be locked in a stereoscopic manner by the connecting assembly, so that connection between the guardrail door body and the door frame is firmer and more reliable.

With reference to FIG. 1 to FIG. 4, a fence according to some embodiments of a third aspect of the disclosure includes at least two fence plates (not shown in the drawings), and it can be understood that three, four or more fence plates may also be provided, which may be specifically determined according to actual needs. The above connecting assembly is arranged between two adjacent fence plates. Specifically, one of the first connector 100 and the second connector 200 is arranged on one of the fence plates, and the other is arranged on the other adjacent fence plate. By connecting two adjacent fence plates with the above connecting assembly, the two fence plates can be doubly locked, and it is difficult for children to unlock, thus being safe and reliable. Moreover, two fence plates can be locked in a stereoscopic manner by the above connecting assembly, so that connection between two fence plates is firmer and more reliable.

The embodiments of the disclosure are described in detail with reference to the accompanying drawings above, but the disclosure is not limited to the above embodiments, and various changes may also be made within the knowledge scope of those of ordinary skills in the art without departing from the purpose of the disclosure.

What is claimed is:

1. A connecting assembly, comprising:

a first connector;

a second connector;

a transverse locking device, wherein the transverse locking device comprises a transverse slot and a transverse pin which are capable of being matched with each other, the transverse pin is movably arranged on the second connector, the transverse slot is correspondingly arranged on the first connector, and the transverse pin is movable along a transverse direction to insert into or withdraw from the transverse slot;

a longitudinal locking device arranged between the first connector and the second connector, wherein the longitudinal locking device is capable of limiting relative movement of the first connector and the second connector in the transverse direction;

the longitudinal locking device comprises a longitudinal slot and a longitudinal pin which are capable of being matched with each other, one end of the second connector opposite to the first connector is internally provided with an accommodating cavity, an opening communicated with the accommodating cavity is provided on a lower surface of the second connector, and the longitudinal pin is movably mounted inside the accommodating cavity;

the accommodating cavity is internally provided with an elastic member for driving one end of the longitudinal pin to pass through the opening and extend out of the accommodating cavity;

a lower portion of one end of the first connector opposite to the second connector is provided with a connecting portion extending and protruding in the transverse direction, the longitudinal slot is formed on an upper surface of the connecting portion and an opening of the longitudinal slot faces upwardly, the longitudinal pin is movable along a longitudinal direction to insert into the longitudinal slot, or the longitudinal pin is movable along the longitudinal direction to withdraw from the longitudinal slot;

a guiding inclined plane is arranged between the connecting portion and the longitudinal pin for guiding the longitudinal pin to move towards inside of the accommodating cavity, and the guiding inclined plane is formed on the connecting portion or formed on the longitudinal pin.

2. The connecting assembly of claim 1, wherein, a clamping block is arranged on an outside wall of the longitudinal pin within the accommodating cavity;

the elastic member is a compression spring sleeved around a peripheral wall of the longitudinal pin, and one end of the compression spring is configured to abut against the clamping block, and the other end of the compression spring is configured to abut against an inner wall of the accommodating cavity.

3. The connecting assembly of claim 1, wherein, the transverse slot is formed at the end of the first connector opposite to the second connector, the end of the second connector opposite to the first connector is provided with a cavity, and a side wall of the cavity is provided with a notch facing the transverse slot, the transverse pin is movably mounted in the cavity, and the transverse pin is insertable into the transverse slot by passing through the notch.

4. The connecting assembly of claim 3, wherein, a side wall of the second connector is provided with a strip-shaped slot communicated with the cavity, the transverse pin is connected with a connecting rod, and one end of the connecting rod is arranged to pass through the strip-shaped slot and be connected with a driving sheet located outside the cavity.

5. A door guardrail, comprising:

a door frame and a guardrail door body hinged on one side wall of the door frame, wherein between the guardrail door body and the door frame, a connecting assembly is arranged, comprising:

a first connector;

a second connector;

a transverse locking device, wherein the transverse locking device comprises a transverse slot and a transverse pin which are capable of being matched with each other, the transverse pin is movably arranged on the second connector, the transverse slot is correspondingly arranged on the first connector, and the transverse pin is movable along a transverse direction to insert into or withdraw from the transverse slot;

a longitudinal locking device arranged between the first connector and the second connector, wherein the longitudinal locking device is capable of limiting relative movement of the first connector and the second connector in the transverse direction;

the longitudinal locking device comprises a longitudinal slot and a longitudinal pin which are capable of being matched with each other, one end of the second connector opposite to the first connector is internally provided with an accommodating cavity, an opening communicated with the accommodating cavity is provided on a lower surface of the second connector, and the longitudinal pin is movably mounted inside the accommodating cavity;

the accommodating cavity is internally provided with an elastic member for driving one end of the longitudinal pin to pass through the opening and extend out of the accommodating cavity;

a lower portion of one end of the first connector opposite to the second connector is provided with a connecting portion extending and protruding in the transverse direction, the longitudinal slot is formed on an upper surface of the connecting portion and an opening of the longitudinal slot faces upwardly, the longitudinal pin is movable along a longitudinal direction to insert into the longitudinal slot, or the longitudinal pin is movable along the longitudinal direction to withdraw from the longitudinal slot;

a guiding inclined plane is arranged between the connecting portion and the longitudinal pin for guiding the longitudinal pin to move towards inside of the accommodating cavity, and the guiding inclined plane is formed on the connecting portion or formed on the longitudinal pin.

6. The door guardrail of claim 5, wherein, a clamping block is arranged on an outside wall of the longitudinal pin within the accommodating cavity;

the elastic member is a compression spring sleeved around a peripheral wall of the longitudinal pin, and one end of the compression spring is configured to abut against the clamping block, and the other end of the compression spring is configured to abut against an inner wall of the accommodating cavity.

7. The door guardrail of claim 5, wherein, the transverse slot is formed at the end of the first connector opposite to the second connector, the end of the second connector opposite to the first connector is provided with a cavity, and a side wall of the cavity is provided with a notch facing the transverse slot, the transverse pin is movably mounted in the cavity, and the transverse pin is insertable into the transverse slot by passing through the notch.

8. The door guardrail of claim 7, wherein, a side wall of the second connector is provided with a strip-shaped slot communicated with the cavity, the transverse pin is connected with a connecting rod, and one end of the connecting rod is arranged to pass through the strip-shaped slot and be connected with a driving sheet located outside the cavity.

* * * * *